US007891023B1

(12) United States Patent
Hill

(10) Patent No.: US 7,891,023 B1
(45) Date of Patent: Feb. 22, 2011

(54) PEACE OFFICER'S SHIRT AND SUSPENDER SET FOR SUPPORTING A DUTY BELT

(76) Inventor: Elton N. Hill, 1210 Talon Rd., Lincoln, NE (US) 68505

( * ) Notice: Subject to any disclaimer, the term of this patent is extended or adjusted under 35 U.S.C. 154(b) by 854 days.

(21) Appl. No.: 11/879,094

(22) Filed: Jul. 16, 2007

(51) Int. Cl.
*A41F 19/00* (2006.01)

(52) U.S. Cl. ..... 2/310; 2/69; 2/305; 2/327; 224/583

(58) Field of Classification Search ..... 2/310, 2/331, 117, 93, 94, 305, 320, 327, 106, 461, 2/69, 326, 2.5, 455; 224/576, 322
See application file for complete search history.

(56) References Cited

U.S. PATENT DOCUMENTS

| | | | | | |
|---|---|---|---|---|---|
| 770,761 | A * | 9/1904 | Lemly | 224/649 |
| 1,335,927 | A * | 4/1920 | Ainsworth | 2/310 |
| 1,398,962 | A * | 12/1921 | Graves | 2/331 |
| 1,446,948 | A * | 2/1923 | Taylor | 2/117 |
| 1,839,143 | A * | 12/1931 | Ellis | 2/305 |
| 1,852,030 | A * | 4/1932 | Shipman | 2/327 |
| 1,983,636 | A * | 12/1934 | Palkens | 450/113 |
| 2,133,505 | A * | 10/1938 | Green | 2/106 |
| 2,411,724 | A * | 11/1946 | Hill | 51/298 |
| 2,682,669 | A * | 7/1954 | Valentine et al. | 2/310 |
| 3,167,786 | A * | 2/1965 | Johnson | 2/327 |
| 3,401,857 | A * | 9/1968 | Wilson et al. | 224/637 |
| 4,923,105 | A * | 5/1990 | Snyder | 224/255 |
| 5,214,806 | A * | 6/1993 | Flores | 2/312 |
| 5,319,806 | A * | 6/1994 | Hermann et al. | 2/461 |
| 5,413,262 | A * | 5/1995 | Dewire et al. | 224/675 |
| 5,488,738 | A * | 2/1996 | Seamans | 2/69 |
| 5,497,923 | A * | 3/1996 | Pearson et al. | 224/639 |
| 5,611,079 | A * | 3/1997 | Bain, III | 2/455 |
| 5,623,735 | A | 4/1997 | Perry | |
| 6,021,528 | A * | 2/2000 | Jurga et al. | 2/326 |
| 6,088,831 | A * | 7/2000 | Jensen et al. | 2/2.5 |
| 6,216,931 | B1 * | 4/2001 | Trawinski | 224/583 |
| 6,766,532 | B1 * | 7/2004 | Cabana | 2/44 |
| 6,804,834 | B1 | 10/2004 | Mok | |
| 6,959,455 | B2 * | 11/2005 | Hall | 2/340 |
| 7,318,542 | B2 * | 1/2008 | Godshaw et al. | 224/674 |
| D581,633 | S * | 12/2008 | Seibold | D2/841 |
| 7,596,813 | B2 * | 10/2009 | Borowski et al. | 2/93 |
| 2002/0112275 | A1 * | 8/2002 | Hall | 2/310 |
| 2003/0110550 | A1 * | 6/2003 | Guibord | 2/312 |
| 2006/0185056 | A1 * | 8/2006 | Zwick | 2/115 |
| 2006/0289585 | A1 * | 12/2006 | Godshaw et al. | 224/625 |
| 2009/0070915 | A1 * | 3/2009 | Hill | 2/117 |

* cited by examiner

*Primary Examiner*—Katherine Morin
*Assistant Examiner*—Richale L Quinn
(74) *Attorney, Agent, or Firm*—Dennis L. Thomte; Thomte Patent Law Office LLC

(57) ABSTRACT

A suspender set and peace officer's shirt are described wherein the suspenders for the duty belt are located beneath the officer's shirt with only a portion of the suspender set extending outwardly through the front and rear of the shirt for connection to the duty belt worn by the officer.

8 Claims, 7 Drawing Sheets

PEACE OFFICER'S SHIRT AND SUSPENDER SET FOR SUPPORTING A DUTY BELT

BACKGROUND OF THE INVENTION

1. Field of the Invention

This invention relates to a peace officer's shirt and suspender set for supporting a duty belt and more particularly to a suspender set for supporting a duty belt which is positioned for the most part inside the shirt.

2. Description of the Related Art

Peace officers such as police officers, highway patrolmen, deputy sheriffs, etc., normally wear a duty belt which supports heavy gear such as a pistol, cartridges, pouches, radio, etc. The weight of the duty belt and the gear supported thereon is carried by the back of the officer and many officers have experienced severe back problems as a result of wearing the heavy duty belt. Suspenders could be used to support the duty belt, but the suspenders detract from the appearance of the officer's uniform. Further, if conventional suspenders are worn by the police officer to support the duty belt, a person involved in a fight or scuffle with the officer could grab the exposed suspenders to gain an unfair leverage or advantage over the officer during the fight or scuffle.

SUMMARY OF THE INVENTION

A peace officer's shirt and suspender set for supporting a duty belt is disclosed wherein the suspenders are located primarily inside the shirt with only a small portion thereof extending through openings formed in the shirt for attachment to the duty belt. In one form of the invention, the suspender set is comprised of first and second flexible strap members which are length adjustable and which extend over the shoulders of the officer. Preferably, the suspenders extend through guide loops which are secured to the inside surface of the shirt above the shoulders of the officer. A buckle fastener is secured to each of the opposite ends of the first and second strap members and have belt loops secured thereto which may be extended through slits or openings formed in the front and rear sides of the shirt. The duty belt is extended through the belt loops so that the weight of the duty belt and gear supported thereon is carried by the shoulders rather than the back of the officer. In a second embodiment of the invention, the rearward ends of the first and second strap members are joined together with a single strap member extending downwardly from the juncture thereof through a single opening in the back of the officer's shirt. A modified form of the belt loops is also described which enables the belt loops to be disconnected from the duty belt without the need for removing the duty belt from the officer's waist. Preferably, the openings in the shirt are formed approximately one inch above the duty belt so that a minimum amount of the suspenders is exposed.

It is therefore a principal object of the invention to provide an improved peace officer's shirt and suspender set for supporting a duty belt.

A further object of the invention is to provide a device of the type described wherein the weight of the duty belt and the gear supported thereon is supported by the officers shoulders rather than the officer's back.

Still another object of the invention is to provide a suspender set of the type described wherein the belt loops thereof may be opened so that the duty belt may be disconnected from the suspender set without removing the duty belt from the officer's waist.

A further object of the invention is to provide peace officer's shirt and suspender set for supporting a duty belt where only a small portion of the suspender set is exposed at the outer surface of the officer's shirt.

These and other objects will be obvious to those skilled in the art.

DETAILED DESCRIPTION OF THE INVENTION

Figure 1:
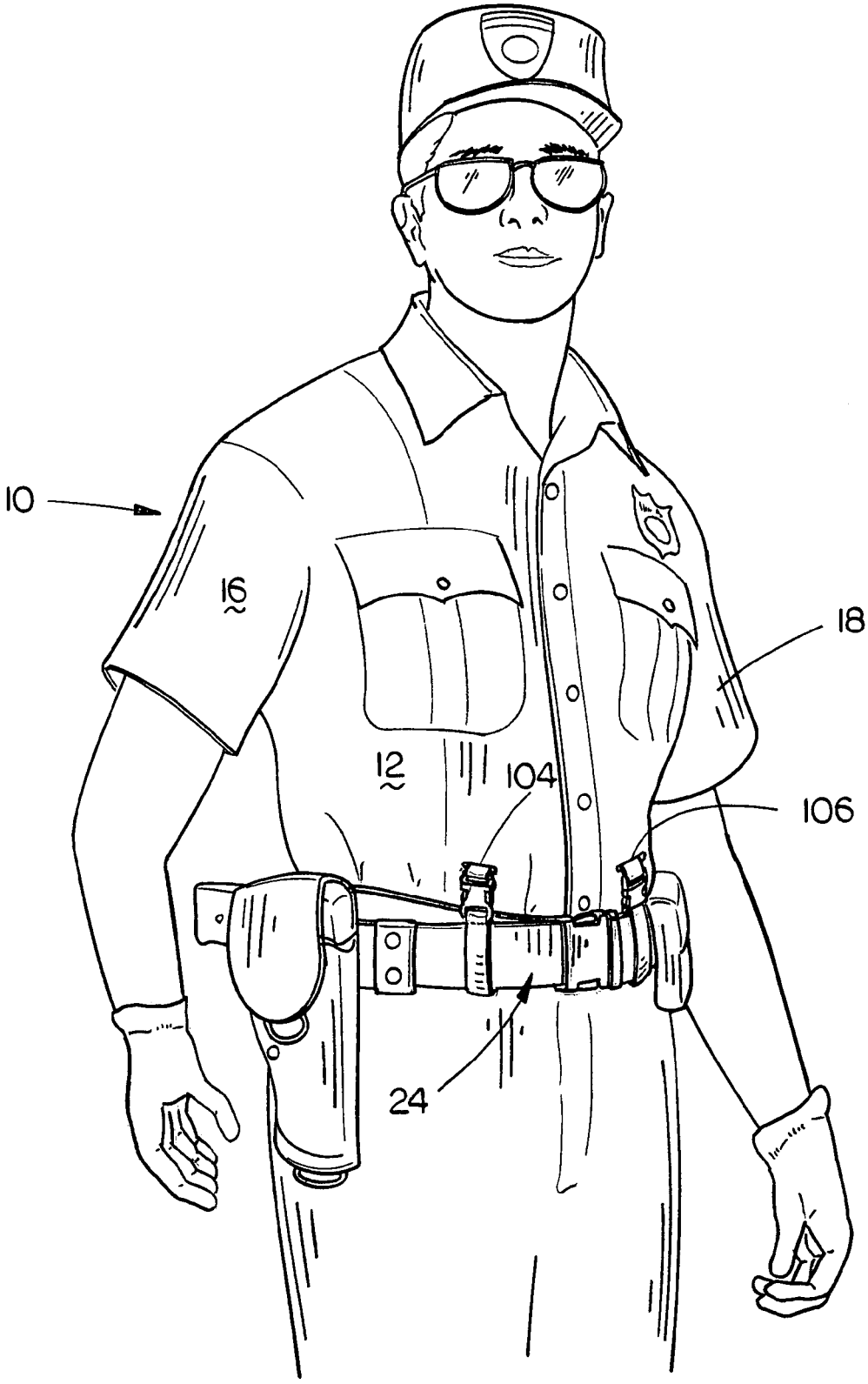
FIG. 1 is a perspective view illustrating a peace officer wearing a duty belt which is supported by the suspender set of this invention.
Figure 2:
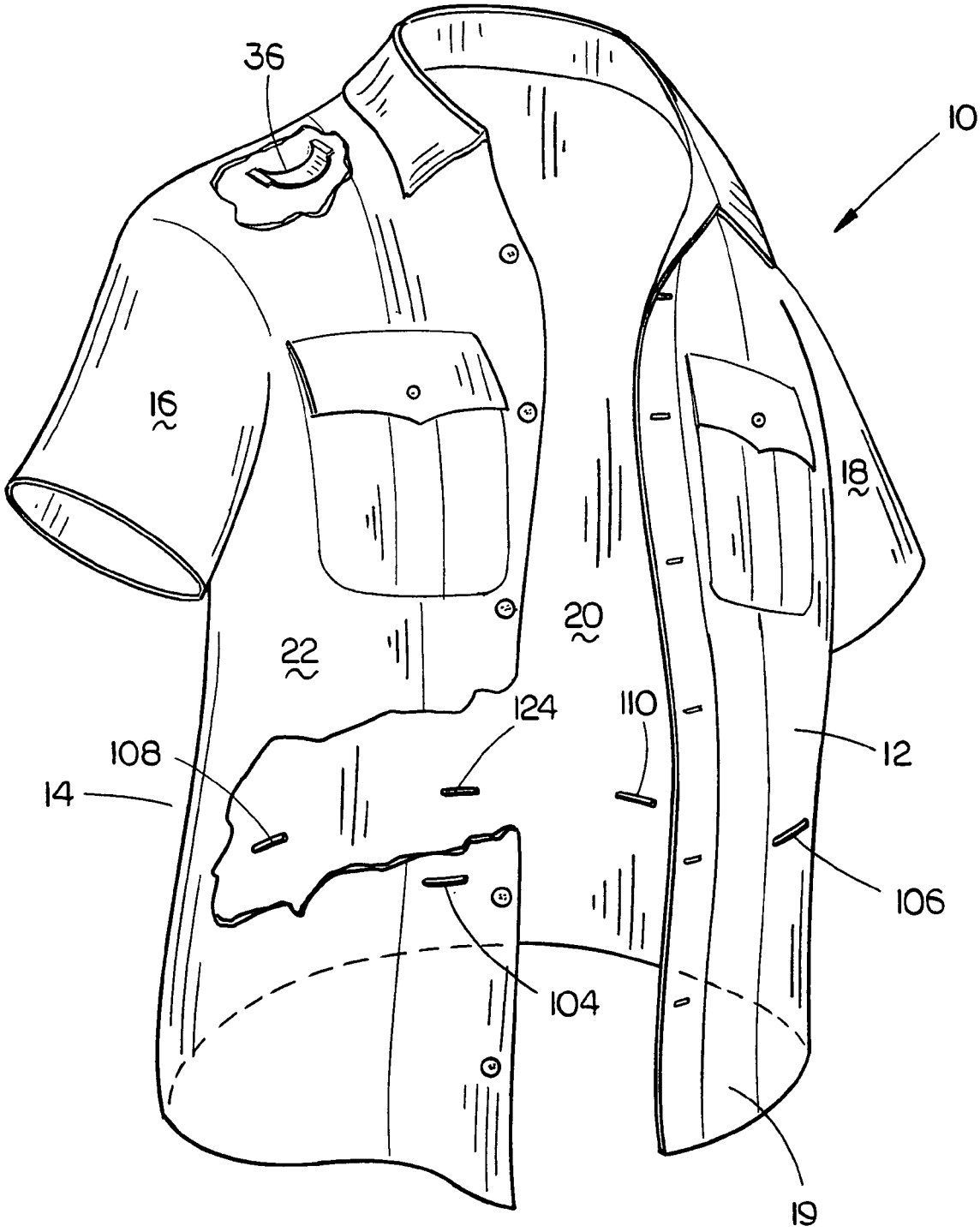
FIG. 2 is a partial perspective view of the shirt of this invention.

The numeral 10 refers generally to a peace officer's shirt having a front 12, a back 14, sleeves 16 and 18, with the tail 19 thereof being worn tucked into the officer's pants. The shirt 10 has an inner surface 20 and an outer surface 22.

The numeral 24 refers to a peace officer's duty belt of conventional design which is adapted to extend around the officers waist and which supports heavy gear thereon such as cartridges, pistol, flashlight, handcuffs, etc. The numeral 26 refers to one embodiment of the suspender set of this invention which includes first and second flexible strap members 28 and 30, respectively. The strap members 28 and 30 are length adjustable by means of the sliding buckles 32 and 34, respectively. The suspender set 26 of this invention is intended to be worn under the officer's shirt and to extend over the officer's shoulders. It is preferred, but not necessary, that a pair of guide loops 36 are sewn or otherwise secured to the inner surface 20 of the shirt so as to be positioned over the shoulders of the officer. The strap members 28 and 30 are adapted to extend through the guide loops 36. For purposes of description, the first strap member will be described as having a front end 40 and a rear end 42 while the second strap member 30 will be described as having a front end 44 and a rear end 46.

The numeral 48 refers to a first buckle fastener having first and second buckles fastener members 50 and 52 which may be selectively fastened together in conventional fashion. The first buckle fastener member 50 of the buckle fastener 48 is secured to the front end 40 of the strap member 28. The numeral 54 designates a second buckle fastener having first and second buckle fastener members 56 and 58, respectively, which may be selectively fastened together in conventional fashion. The first buckle fastener member 56 of the buckle fastener 54 is secured to the front end 44 of the strap member 30.

The numeral 60 refers to a third buckle fastener including first and second buckle fastener members 62 and 64, respectively, which may be selectively fastened together in conventional fashion. The first buckle fastener member 62 of the buckle fastener 60 is secured to the rear end 42 of the strap member 28.

The numeral 66 refers to a fourth buckle fastener including first and second buckle fastener members 68 and 70, respectively, which may be selectively fastened together in conventional fashion. The first buckle fastener member 68 of the buckle fastener 66 is secured to the rear end 46 of the strap member 30. The buckle fastener members 48, 54, 60 and 66 are of conventional design and are commonly referred to as side-release buckle fasteners. The side-release buckle fasteners described herein are comprised of a plastic material and may be obtained from American Cord and Webbing of Woon Socket, R.I.

Figure 3:
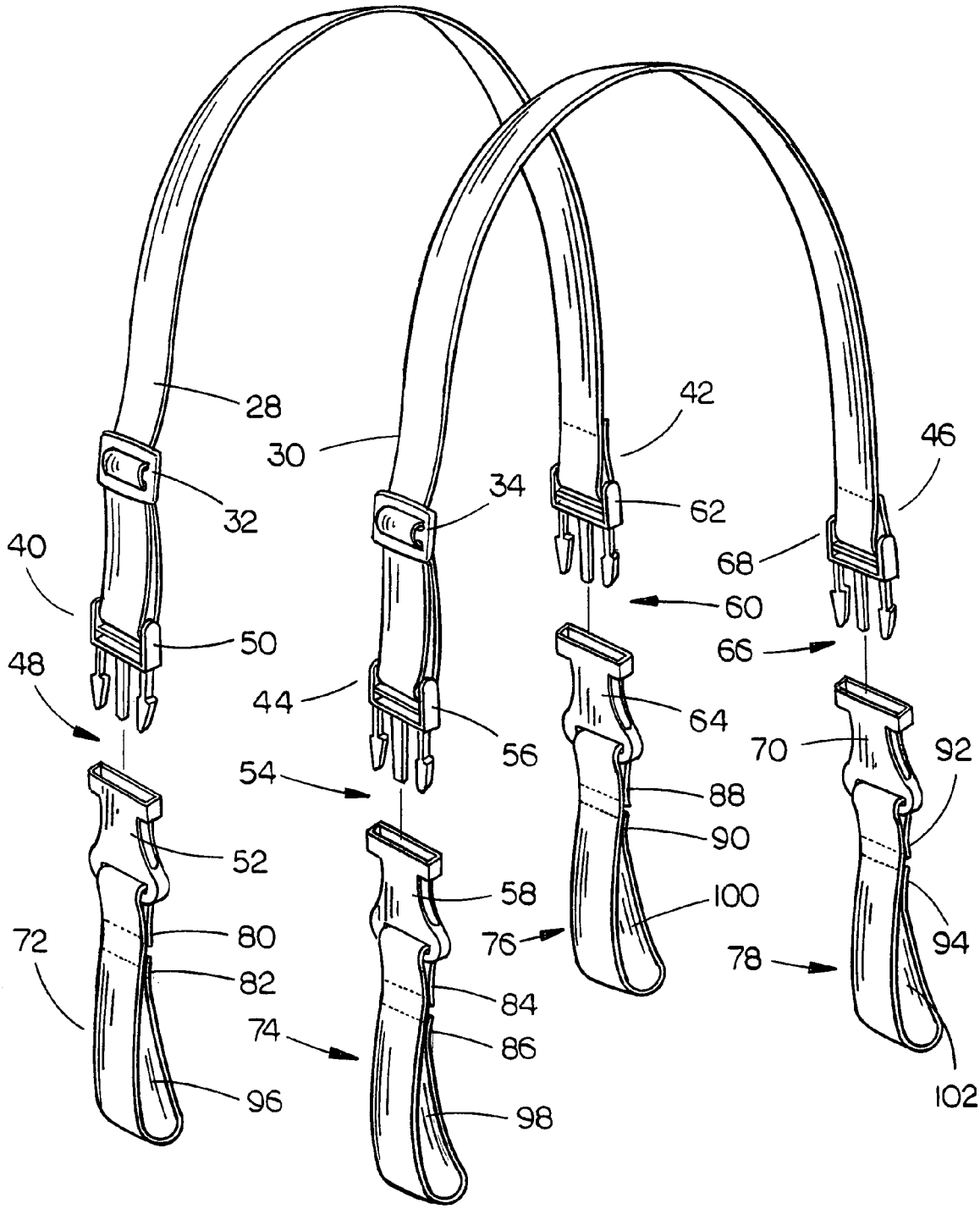
FIG. 3 is an exploded perspective view of one form of the suspender set of this invention.

The numerals 72, 74, 76 and 78 refer to third, fourth, fifth and sixth flexible strap members, respectively, having first and second ends 80 and 82, 84 and 86, 88 and 90, and 92 and 94, respectively. The first ends of the third, fourth, fifth and sixth strap members are secured to the second buckle fastener members of the buckle fasteners 48, 54, 60 and 66, respectively, by stitching, as seen in FIG. 3, or by hook and loop fasteners. The second ends of the third, fourth, fifth and sixth strap members 72, 74, 76 and 78 are secured to the strap members to define belt loops 96, 98, 100 and 102, respectively, adapted to have the duty belt extending therethrough so that a large portion of the weight of the duty belt is carried by the shoulders of the officer.

The shirt 10 has spaced-apart openings 104 and 106 formed in the front 12 thereof above the duty belt 24 so that the third and fourth strap members 72 and 74 may extend outwardly therethrough to the outer surface of the shirt. The shirt 10 also has third and fourth spaced-apart openings 108 and 110 formed in the back 14 thereof above the duty belt 24 so that the fifth and sixth strap member 76 and 78 may extend outwardly therethrough, respectively, to the outer surface of the shirt 10. Preferably, the openings 104, 106, 108 and 110 are formed in the shirt approximately one inch above the belt. Preferably, the duty belt 24 is black and the strap members 72, 74, 76 and 78 are also black so as to esthetically blend together.

Figure 6:
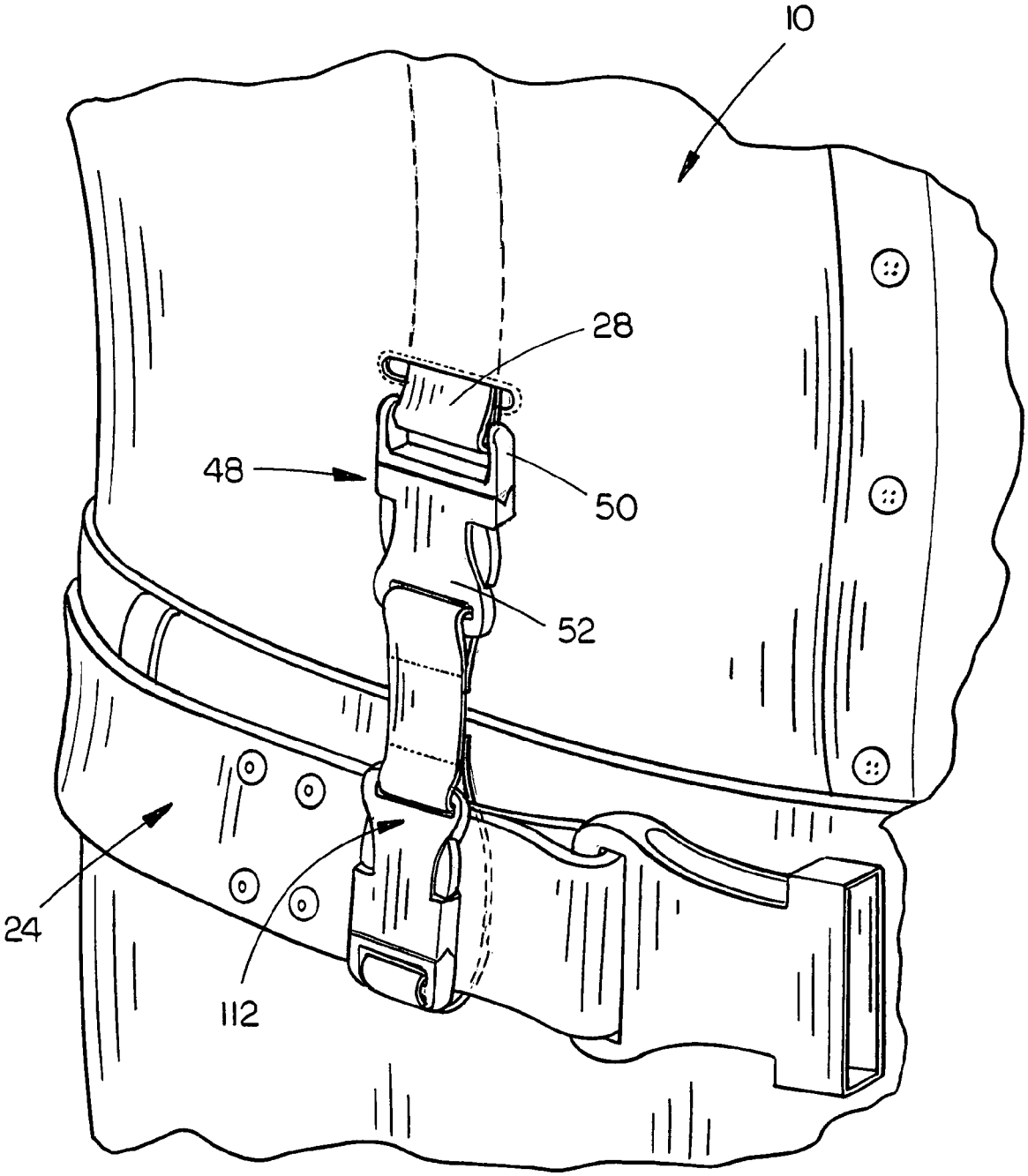
FIG. 6 is a view similar to FIG. 5 except that a modified form of the belt loop is utilized.
Figure 7:
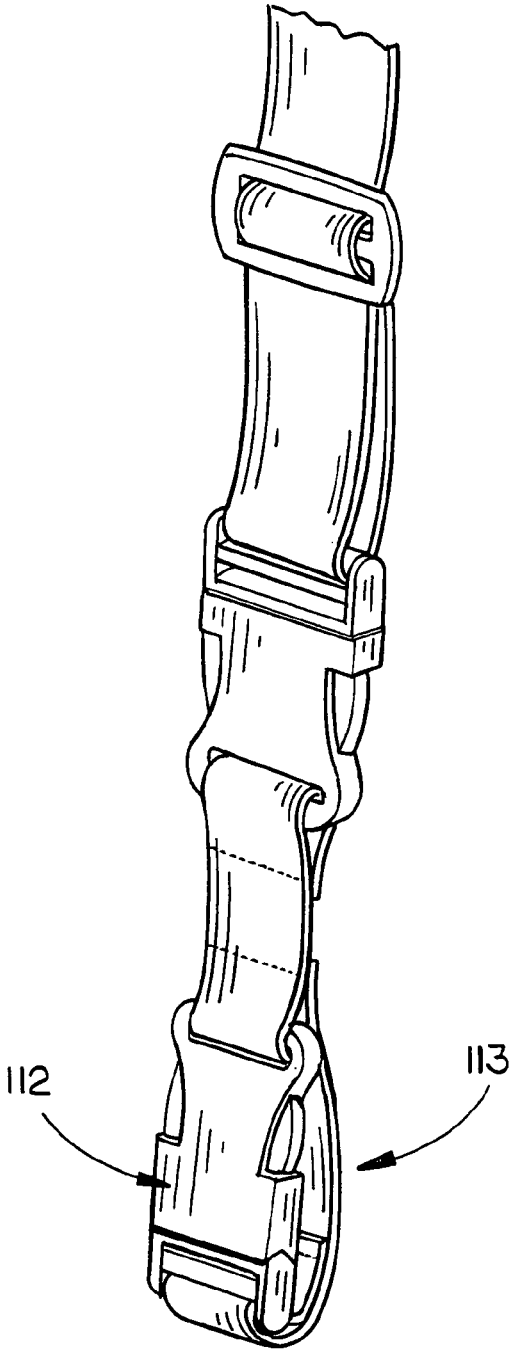
FIG. 7 is a perspective view of the modified loop in a closed position.
Figure 8:
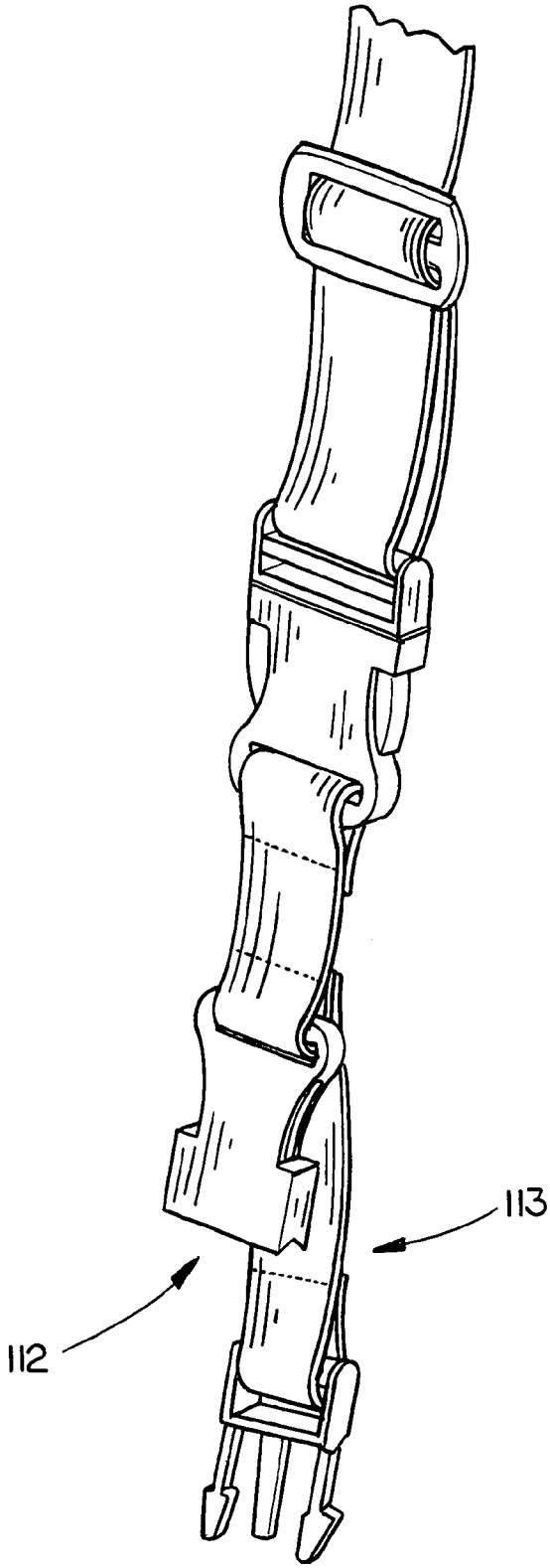
FIG. 8 is a view similar to FIG. 7 except that the belt loop has been opened.

The loops 96, 98, 100 and 102 on the strap members 72, 74, 76 and 78 are shown to be formed by stitching, however, the strap members 72, 74, 76 and 78 and the loops thereon may be replaced by the structure illustrated in FIGS. 6-8 so that the duty belt 24 may be disconnected from the suspender set without removing the duty belt from the officer's waist. As seen in FIGS. 6-8, the belt loop may be formed by including a buckle fastener 112 therein so that the loop may be opened. The buckle fastener is of the type described above and includes buckle fasteners member which are selectively connected together to form one side of the loop. The modified loop illustrated in FIGS. 6-8 is referred to generally by the reference numeral 113.

Figure 4:
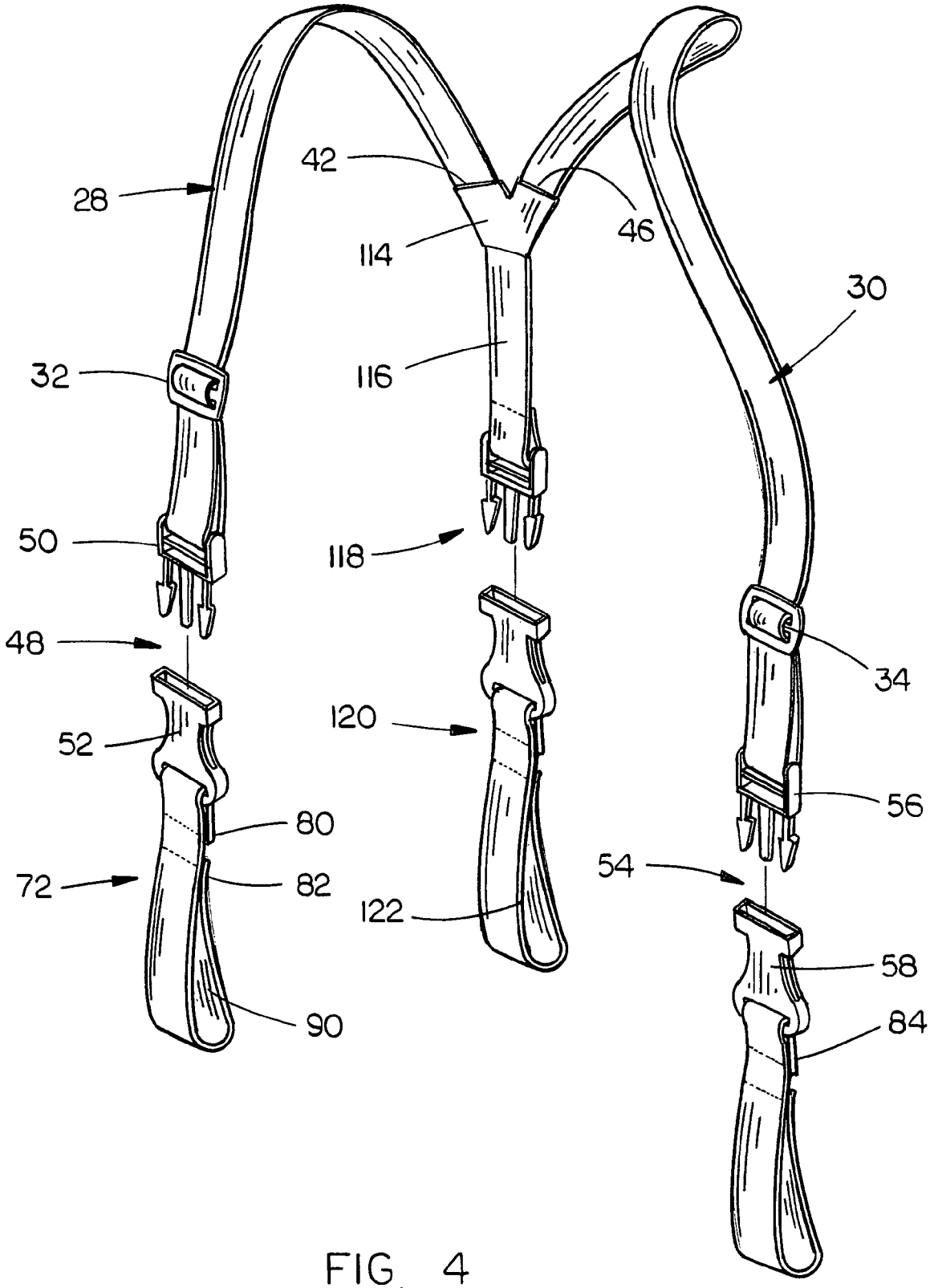
FIG. 4 is an exploded perspective view of a modified form of the suspender set of this invention.
Figure 5:
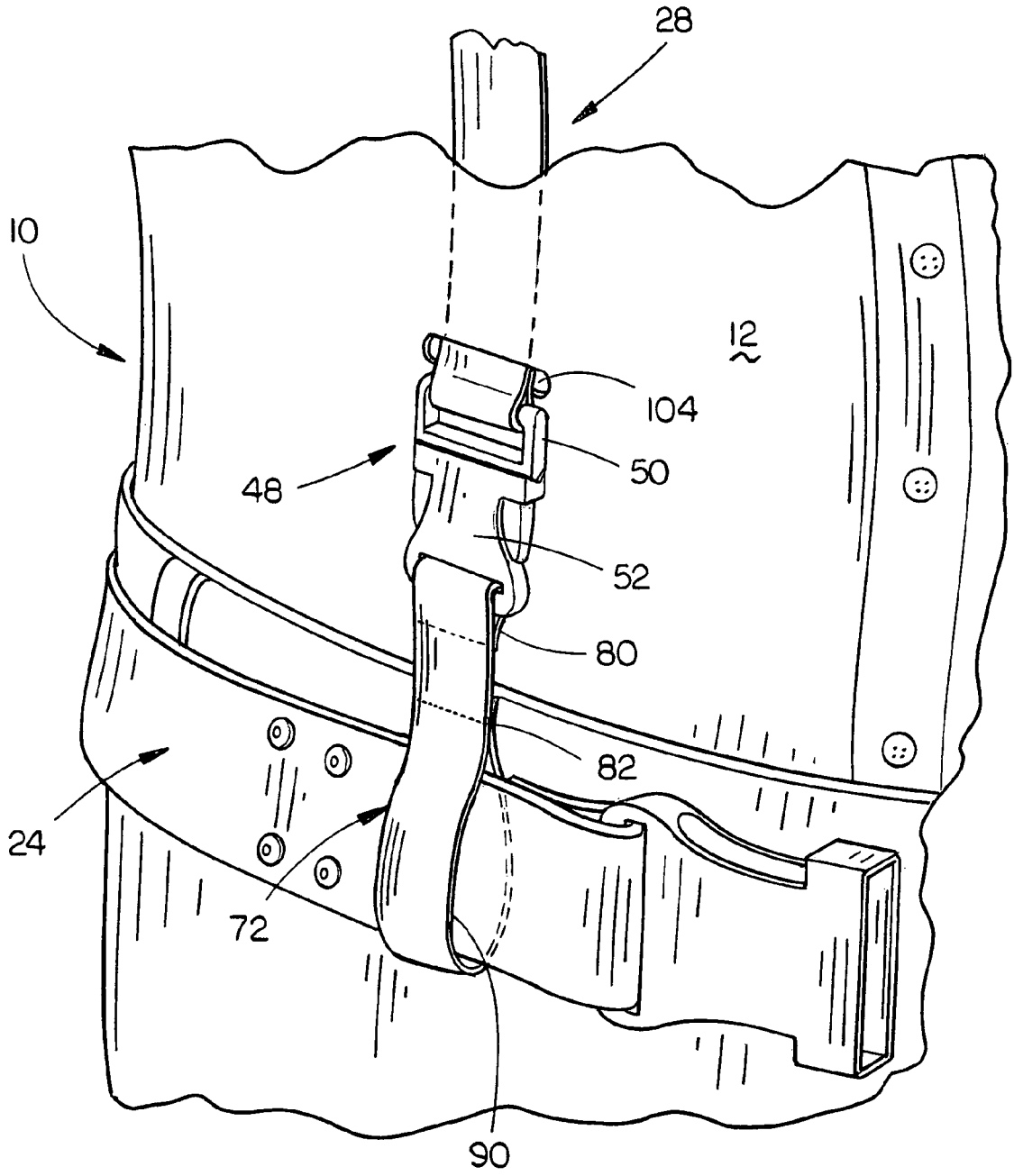
FIG. 5 is a partial perspective view illustrating the relationship of the first embodiment of this invention and the peace officers duty belt.

Although it is preferred that there be four support points between the suspender set and the duty belt, it may be possible to have two support points at the front of the duty belt and only one support point at the rear end of the duty belt. FIG. 4 illustrates a structure wherein the rear end 42 of strap member 28 and the rear end 46 of strap member 30 are joined together at 114. A strap member 116 is secured at its upper end to the juncture 114 of strap members 28 and 30 and extends downwardly therefrom. A buckle fastener 118 of the type described hereinabove is secured to the lower end of strap member 116. Strap member 120 is secured at its upper end to the lower end of the buckle fastener 118 and has a belt loop 122 formed thereon. The belt loop 122 may be of either design described hereinabove. If the structure of FIG. 4 is used, there is only the need for a single opening 124 to be formed in the rear of the shirt to enable the strap member 120 to extend therethrough for connection to the duty belt.

Thus it can be seen that a novel suspender set and shirt have been provided which enables the weight of the duty belt to be carried by the shoulders of the officer rather than the back of the officer. The vast majority of the suspender set is located beneath the shirt so as not to detract from the appearance of the ensemble. Further, the fact that the majority of the suspender set is located beneath the shirt prevents a person from grabbing the same should the officer be involved in a scuffle or fight with a person. Only a small portion of the suspender set is exposed above the duty belt and is preferably the same color as the belt so as to blend therein. The buckle fasteners described herein enable the suspender set to be quickly and easily attached to the duty belt and detached therefrom.

Thus it can be seen that the invention accomplishes at least all of the stated objectives.

I claim:

1. In combination:

a peace officer's shirt having a front, a back, sleeves, and a tail which is worn tucked into the wearer's pants, said shirt having an inner surface and an outer surface;

a peace officer's duty belt extending around the officer's waist which supports heavy gear;

a suspender set comprising first and second flexible strap members;

said suspender set intended to be worn under the officer's shirt and to extend over the officers shoulders;

each of said first and second strap members having a front end and a rear end;

a first buckle fastener including first and second buckle fastener members which may be selectively fastened together;

said first buckle fastener member of said first buckle fastener means being secured to said front end of said first strap member;

a second buckle fastener including first and second buckle fastener members which may be selectively fastened together;

said first buckle fastener member of said second buckle fastener being secured to said front end of said second strap member;

a third buckle fastener including first and second buckle fastener members which may be selectively fastened together;

said first buckle fastener member of said third buckle fastener being secured to said rear end of said first strap member;

a fourth buckle fastener including first and second buckle fastener members which may be selectively fastened together;

said first buckle fastener member of said fourth buckle fastener being secured to said rear end of said second strap member;

third, fourth, fifth and sixth flexible strap members having first and second ends;

said first ends of said third, fourth, fifth and sixth strap members being secured to said second buckle fastener members of said first, second, third and fourth buckle fasteners respectively by hook and loop fasteners;

said shirt having first and second spaced-apart openings formed in said front thereof above said duty belt so that said third and fourth strap members may extend outwardly therethrough to said outer surface of said shirt;

said shirt having third and fourth spaced-apart openings formed in said back thereof above said duty belt so that said fifth and sixth strap members may extend outwardly therethrough to said outer surface of said shirt;

each of said second ends of said third, fourth, fifth and sixth strap members having a belt loop thereon adapted to have said duty belt extending therethrough so that at least some of the weight of said duty belt is carried by the shoulders of the officer.

2. The combination of claim 1 wherein each of said first and second strap members are length adjustable.

3. The combination of claim 1 wherein each of said first, second, third and fourth buckle fasteners are of the side-release type.

4. In combination:

a peace officer's shirt having a front, a back, sleeves, and a tail which is worn tucked into the officer's pants, said shirt having an inner surface and an outer surface;

a peace officer's duty belt extending around the officer's waist and which supports heavy gear;

a suspender set comprising first and second flexible strap members having front and rear ends;

said suspender set intended to be worn under the officer's shirt and to extend over the officer's shoulders;

a first buckle fastener including first and second buckle fastener members which may be selectively fastened together;

said first buckle fastener member of said first buckle fastener means being secured to said front end of said first strap member;

a second buckle fastener including first and second buckle fastener members which may be selectively fastened together;

said first buckle fastener member of said second buckle fastener being secured to said front end of said second strap member;

said rear ends of said first and second strap members being operatively joined together;

a third flexible strap having upper and lower ends;

said upper end of said third strap member being secured to the juncture of said rear ends of said first and second strap members and extending downwardly therefrom;

a third buckle fastener including first and second buckle fastener members which may be selectively fastened together;

said first end of said third buckle fastener being secured to said lower end of said third strap member;

fourth and fifth flexible strap members having first and second ends;

said first ends of said fourth and fifth strap members being secured to said second buckle fastener members of said first and second buckle fasteners respectively by hook and loop fasteners;

a sixth flexible strap member having first and second ends;

said first end of said sixth strap member being secured to said second buckle member of said third buckle fastener by a hook and loop fastener;

said shirt having first and second spaced-apart openings formed in said front thereof above said duty belt so that said fourth and fifth strap members may extend outwardly therethrough to said outer surface of said shirt;

said shirt having a third opening formed in said back thereof above said duty belt so that said sixth strap member may extend outwardly therethrough to said outer surface of said shirt;

each of said second ends of said fourth and fifth strap members and said lower end of said sixth strap member having a belt loop thereon adapted to have said duty belt extending therethrough so that at least some of the weight of said duty belt is carried by the shoulders of the officer.

5. The combination of claim 4 wherein each of said first and second strap members are length adjustable.

6. The combination of claim 4 wherein each of said first, second and third buckle fasteners are of the side-release type.

7. In combination:

a peace officer's shirt having a front, a back, sleeves, and a tail which is worn tucked into the wearer's pants, said shirt having an inner surface and an outer surface;

a peace officer's duty belt extending around the officer's waist which supports heavy gear;

a suspender set comprising first and second flexible strap members;

said suspender set intended to be worn under the officer's shirt and to extend over the officer's shoulders;

each of said first and second strap members having a front end and a rear end;

a first buckle fastener including first and second buckle fastener members which may be selectively fastened together;

said first buckle fastener member of said first buckle fastener means being secured to said front end of said first strap member;

a second buckle fastener including first and second buckle fastener members which may be selectively fastened together;

said first buckle fastener member of said second buckle fastener being secured to said front end of said second strap member;

a third buckle fastener including first and second buckle fastener members which may be selectively fastened together;

said first buckle fastener member of said third buckle fastener being secured to said rear end of said first strap member;

a fourth buckle fastener including first and second buckle fastener members which may be selectively fastened together;

said first buckle fastener member of said fourth buckle fastener being secured to said rear end of said second strap member;

third, fourth, fifth and sixth flexible strap members having first and second ends;

said first ends of said third, fourth, fifth and sixth strap members being secured to said second buckle fastener members of said first, second, third and fourth buckle fasteners, respectively;

said shirt having first and second spaced-apart openings formed in said front thereof above said duty belt so that said third and fourth strap members may extend outwardly therethrough to said outer surface of said shirt;

said shirt having third and fourth spaced-apart openings formed in said back thereof above said duty belt so that said fifth and sixth strap members may extend outwardly therethrough to said outer surface of said shirt;

each of said second ends of said third, fourth, fifth and sixth strap members having a belt loop thereon adapted to have said duty belt extending therethrough so that at least some of the weight of said duty belt is carried by the shoulders of the officer;

each of said belt loops being selectively openable to permit said belt loops to be disengaged from said duty belt;

each of said belt loops including a buckle fastener including first and second buckle fastener members which may be selectively fastened together.

8. In combination:

a peace officer's shirt having a front, a back, sleeves, and a tail which is worn tucked into the officer's pants, said shirt having an inner surface and an outer surface;

a peace officer's duty belt extending around the officer's waist and which supports heavy gear;

a suspender set comprising first and second flexible strap members having front and rear ends;

said suspender set intended to be worn under the officer's shirt and to extend over the officer's shoulders;

a first buckle fastener including first and second buckle fastener members which may be selectively fastened together;

said first buckle fastener member of said first buckle fastener means being secured to said front end of said first strap member;

a second buckle fastener including first and second buckle fastener members which may be selectively fastened together;

said first buckle fastener member of said buckle fastener being secured to said front end of said second strap member;

said rear ends of said first and second strap members being operatively joined together;

a third flexible strap having upper and lower ends;

said upper end of said third strap member being secured to the juncture of said rear ends of said first and second strap members and extending downwardly therefrom;

a third buckle fastener including first and second buckle fastener members which may be selectively fastened together;

said first end of said third buckle fastener being secured to said lower end of said third strap member;

fourth and fifth flexible strap members having first and second ends;

said first ends of said fourth and fifth strap members being secured to said second buckle fastener members of said first and second buckle fasteners, respectively;

a sixth flexible strap member having first and second ends;

said first end of said sixth strap member being secured to said second buckle fastener of said third buckle fastener;

said shirt having first and second spaced-apart openings formed in said front thereof above said duty belt so that said fourth and fifth strap members may extend outwardly therethrough to said outer surface of said shirt;

said shirt having a third opening formed in said back thereof above said duty belt so that said sixth strap member may extend outwardly therethrough to said outer surface of said shirt;

each of said second ends of said fourth and fifth strap members and said lower end of said sixth strap member having a belt loop thereon adapted to have said duty belt extending therethrough so that at least some of the weight of said duty belt is carried by the shoulders of the officer;

each of said belt loops being selectively openable to permit said belt loops to be disengaged from said duty belt;

each of said belt loops including a buckle fastener including first and second buckle fastener members which may be selectively fastened together.

* * * * *